US011177550B2

(12) United States Patent
Choi et al.

(10) Patent No.: US 11,177,550 B2
(45) Date of Patent: Nov. 16, 2021

(54) MULTI-FED PATCH ANTENNAS AND DEVICES INCLUDING THE SAME

(71) Applicant: Samsung Electronics Co., Ltd., Suwon-si (KR)

(72) Inventors: Dooseok Choi, Hwaseong-si (KR); Thomas Byunghak Cho, Seongnam-si (KR); Seung-chan Heo, Yongin-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 461 days.

(21) Appl. No.: 16/181,543

(22) Filed: Nov. 6, 2018

(65) Prior Publication Data

US 2019/0214703 A1 Jul. 11, 2019

(30) Foreign Application Priority Data

Jan. 11, 2018 (KR) ..... 10-2018-0003888
Mar. 20, 2018 (KR) ..... 10-2018-0032345

(51) Int. Cl.
*H01Q 1/22* (2006.01)
*H01Q 1/48* (2006.01)
(Continued)

(52) U.S. Cl.
CPC ..... *H01Q 1/2283* (2013.01); *H01Q 1/48* (2013.01); *H01Q 9/045* (2013.01);
(Continued)

(58) Field of Classification Search
CPC .. H01Q 1/22; H01Q 1/48; H01Q 9/04; H01Q 21/06; H01Q 3/34; H01Q 25/00
(Continued)

(56) References Cited

U.S. PATENT DOCUMENTS 7,084,815 B2 8/2006 Phillips et al.
7,453,402 B2 11/2008 Rowell et al.
(Continued)

FOREIGN PATENT DOCUMENTS

CN 104901005 A 9/2015
EP 1071161 1/2001
EP 1071161 A1 * 1/2001 ..... H01Q 5/378

OTHER PUBLICATIONS

Hong, W. "Solving the 5G mobile antenna puzzle," IEEE Microwave Magazine, vol. 18, pp. 86-102, 2017.
(Continued)

*Primary Examiner* — Andrea Lindgren Baltzell
(74) *Attorney, Agent, or Firm* — Harness, Dickey & Pierce, P.L.C.

(57) ABSTRACT

A radio frequency (RF) device may include a radio frequency integrated circuit (RFIC) chip and an antenna module on an upper surface of the RFIC chip. The antenna module may include a first patch parallel to the RFIC chip and having an upper surface configured to emit radiation in a vertical direction opposite the first patch from the RFIC chip, a ground plate parallel to the first patch, and between the first patch and the RFIC chip, and a first plurality of feed lines connected to a lower surface of the first patch and configured to supply at least one first differential signal to the first patch from the RFIC chip.

20 Claims, 15 Drawing Sheets

(51) Int. Cl.

| | |
|---|---|
| ***H01Q 21/06*** | (2006.01) |
| ***H01Q 9/04*** | (2006.01) |
| *H01Q 25/00* | (2006.01) |
| *H01Q 3/34* | (2006.01) |

(52) U.S. Cl.
CPC ..... *H01Q 9/0414* (2013.01); *H01Q 21/061* (2013.01); *H01Q 3/34* (2013.01); *H01Q 21/065* (2013.01); *H01Q 25/001* (2013.01)

(58) Field of Classification Search
USPC ..... 343/848
See application file for complete search history.

(56) References Cited

U.S. PATENT DOCUMENTS

| | | | |
|---|---|---|---|
| 8,477,070 | B2 | 7/2013 | Pettus et al. |
| 8,854,264 | B2 | 10/2014 | Feger et al. |
| 9,172,132 | B2 | 10/2015 | Kam et al. |
| 2008/0129635 | A1 | 6/2008 | Surittikul et al. |
| 2009/0028074 | A1 | 1/2009 | Knox |
| 2014/0145883 | A1 | 5/2014 | Baks et al. |
| 2014/0320344 | A1 | 10/2014 | Sanderovich et al. |
| 2015/0015453 | A1 | 1/2015 | Puzella et al. |
| 2015/0236424 | A1 | 8/2015 | Panther et al. |
| 2017/0317418 | A1* | 11/2017 | Garcia ..... G06K 19/07749 |

OTHER PUBLICATIONS

Li, Sensen. "A Millimeter-Wave Duel-Feed Square Loop Antenna for 5G Communications," IEEE Trans. Antenna Propagat., vol. 65, No. 12, pp. 6317-6328, 2017.

Search Report and Written Opinion dated Aug. 20, 2019 in Singapore Application No. 10201811647U.

Extended European Search Report dated May 28, 2019 in European Application No. 18213474.2.

* cited by examiner

| | Dual-fed patch | Single-fed patch |
|---|---|---|
| Antenna gain (total) | 6.52 dBi | 5.92 dBi |
| Radiation patten (2D, $\phi$=90°) |  |  |
| Element. Pout | 10 dBm | 10 dBm |
| Pout_total | 13 dBm | 10 dBm |
| EIRP (cal.) | 19.52 dBm | 15.92 dBm |
| Radiated power (sim.) | −12.11 dBm | −15.62 dBm |
| Dimension | 8 mm x 8 mm | 8 mm x 8 mm |

| | Dual-fed patch | 1by2 patch array |
|---|---|---|
| Antenna gain (total) | 6.52 dBi | 8.69 dBi |
| Radiation patten (2D, $\phi$=90°) |  |  |
| Element. Pout | 10 dBm | 10 dBm |
| Pout_total | 13 dBm | 13 dBm |
| EIRP (cal.) | 19.52 dBm | 21.69 dBm |
| Radiated power (sim.) | −12.11 dBm | −9.91 dBm |
| Dimension | 8 mm x 8 mm | 13 mm x 8 mm |

| | Dual-fed, dual-pol patch | Single-fed patch |
|---|---|---|
| Antenna gain (total) | 5.4 dBi(V-pol), 5.42dBi(H-pol) | 5.92 dBi |
| Radiation patten (2D, ϕ=90°) |  |  |
| Element. Pout | 10 dBm | 10 dBm |
| Pout_total | 13 dBm | 10 dBm |
| EIRP (cal.) | 18.4 dBm(V-pol), 18.42dBm(H-pol) | 15.92 dBm |
| Radiated power (sim.) | −13.17 dBm(V-pol), −12.77dBm(H-pol) | −15.62 dBm |
| Dimension | 8 mm x 8 mm | 8 mm x 8 mm |

MULTI-FED PATCH ANTENNAS AND DEVICES INCLUDING THE SAME

CROSS-REFERENCE TO RELATED APPLICATIONS

This application claims the benefit of Korean Patent Application Nos. 10-2018-0003888, filed on Jan. 11, 2018 and 10-2018-0032345, filed on Mar. 20, 2018, in the Korean Intellectual Property Office, the disclosures of which are incorporated herein in their entirety by reference.

BACKGROUND

The inventive concepts relate to patch antennas, and more particularly, to multi-fed patch antennas and devices including the multi-fed patch antenna.

An antenna used for wireless communication is a reversible device and may include a conductor. A signal may be transmitted by emitting an electromagnetic wave from the conductor, and the signal may be induced by the electromagnetic wave reaching the conductor. A conductor included in an antenna may have various shapes, and an antenna including a conductor having a suitable shape may be used according to an application. For example, a patch antenna, as a planar type antenna, may include a ground plate, a low-loss dielectric material on the ground plate, and a patch of the low-loss dielectric material, and may be used in mobile applications.

In the case of an application involving limited space and power like mobile phones, an antenna having a reduced size may be desired. Also, in wireless communication application, high transmitting power may be employed, leading to high power consumption and heat generation. Accordingly, an antenna having high power efficiency and a limited size may be desired.

SUMMARY

The inventive concepts provide patch antennas, and devices including the patch antennas, having high power efficiency and a reduced size based on a multi-fed structure of the patch antennas.

According to an aspect of the inventive concepts, there is provided a radio frequency (RF) device including a radio frequency integrated circuit (RFIC) chip and an antenna module on an upper surface of the RFIC chip. The antenna module includes a first patch parallel to the RFIC chip and having an upper surface configured to emit radiation in a vertical direction opposite the first patch from the RFIC chip, a ground plate parallel to the first patch, and between the first patch and the RFIC chip, and a first plurality of feed lines connected to a lower surface of the first patch and configured to supply at least one first differential signal to the first patch from the RFIC chip.

According to an aspect of the inventive concepts, there is provided an antenna module including: a ground plate; a first patch parallel to the ground plate and having an upper surface configured to emit radiation in a vertical direction opposite the first patch from the ground plate; and a first plurality of feed lines respectively connected to a first plurality of feed points on a lower surface of the first patch, the first plurality of feed points including a first feed point and a second feed point separated from each other in a first horizontal direction, and a third feed point and a fourth feed point separated from each other in a second horizontal direction perpendicular to the first horizontal direction.

According to an aspect of the inventive concepts, there is provided an RF device including an RFIC chip configured to output a first differential signal and a second differential signal, and an antenna module on an upper surface of the RFIC chip. The antenna module includes a first patch parallel to the RFIC chip and configured to emit radiation in a vertical direction opposite the first patch from the RFIC chip, a ground plate parallel to the first patch, and between the first patch and the RFIC chip, and first differential feed lines and second differential feed lines connected to a lower surface of the first patch and configured to supply the first differential signal and the second differential signal to the first patch.

BRIEF DESCRIPTION OF THE DRAWINGS

For convenience of understanding, in the drawings accompanied by the present specification, sizes of the constituent elements may be exaggerated or reduced.

Some example embodiments will be more clearly understood from the following detailed description taken in conjunction with the accompanying drawings in which.

DETAILED DESCRIPTION

Figure 1:
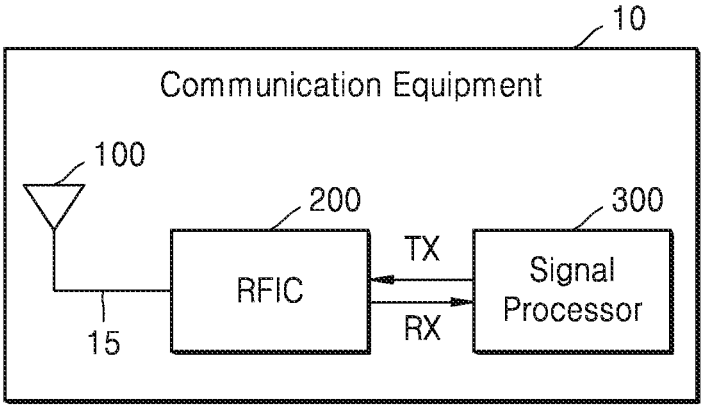
FIG. 1 is a block diagram of a communication device according to some example embodiments.

FIG. 1 is a block diagram of communication equipment 10 according to some example embodiments. As depicted in FIG. 1, the communication equipment 10 may include an antenna 100, may communicate with another communication device in a wireless communication system by transmitting or receiving signals through the antenna 100, and thus, may be referred to as a wireless communication device. According to some example embodiments, the wireless communication system similar to or the same as the wireless communication systems discussed below in association with FIG. 13-14.

A wireless communication system by which the communication equipment 10 communicates with another communication device may be, as non-limiting examples, a wireless communication system that uses a cellular network, such as a 5th Generation (5G) wireless system, a Long Term Evolution (LTE) system, an LTE-advanced system, a Code Division Multiple Access (CDMA) system, or a Global System for Mobile communication (GSM) system, a wireless communication system that uses a Wireless Local Area Network (WLAN) system or another arbitrary wireless communication system. Hereinafter, a wireless communication system that uses a cellular network will be mainly described, but some example embodiments are not limited thereto.

As depicted in FIG. 1, the communication equipment 10 may include the antenna 100, a Radio Frequency Integrated Circuit (RFIC) 200, and a signal processor 300. The antenna 100 and the RFIC 200 may be connected to each other through a feed line 15. In the present specification, the antenna 100 may be referred to as an antenna module, and the antenna 100 and the feed line 15 altogether may be referred to as an antenna module. Also, the antenna 100, the feed line 15, and the RFIC 200 altogether may be referred to as an RF system or an RF device.

In a transmitting mode, the RFIC 200 may provide a signal generated by processing a transmitting signal TX provided from the signal processor 300 to the antenna 100 through the feed line 15. Also, in a receiving mode, the RFIC 200 may provide a receiving signal RX to the signal processor 300 by processing a signal received from the antenna 100. For example, the RFIC 200 may include a transmitter, and the transmitter may include a filter, a mixer, and a power amplifier (PA). Also, the RFIC 200 may include a receiver, and the receiver may include a filter, a mixer, and a low noise amplifier (LNA). In some example embodiments, an RFIC may include a plurality of transmitters and receivers and may include a transceiver in which a transmitter and a receiver are combined with each other.

The signal processor 300 may generate a transmitting signal TX by processing a signal including information to be transmitted and may generate a signal including information by processing a receiving signal RX. For example, in order to generate a transmitting signal TX, the signal processor 300 may include an encoder, a modulator, and a digital-to analog converter (DAC). Also, in order to process a receiving signal RX, the signal processor 300 may include an analog-to-digital converter (ADC), a demodulator, and a decoder. The signal processor 300 may generate a control signal to control the RFIC 200, may set a transmitting mode or a receiving mode through the control signal, and may control power and gains of constituent elements included in the RFIC 200. In some example embodiments, the signal processor 300 may include at least one core, and a memory for storing commands executed by the at least one core. Also, at least a portion of the signal processor 300 may include a software block stored in the memory and operations described herein as being performed by the signal processor 300 may be performed by the at least one core executing the commands and/or software block stored in the memory. In some example embodiments, the signal processor 300 may include a logic circuit designed through a logic synthesis, and at least a portion of the signal processor 300 may include a hardware block realized by the logic circuit.

The wireless communication system may define a high spectrum band for transmitting a large amount of data. For example, a 5G cellular system (or a 5G wireless system) officially designated as an IMT-2020 by the International Telecommunication Union (ITU) defines a mmWave greater than 24 GHz. The mmWave enables wide band transmission, and enables miniaturization of an RF system, that is, the antenna 100 and the RFIC 200. The mmWave may provide increased directionality but also increases attenuation, and thus, reduction in the attenuation may be desired.

In order to mitigate signal attenuation caused by a high frequency band, high transmission power may be used. According to a Friis transmission formula, transmission power may be calculated by multiplying an output power of a power amplifier and a gain of the antenna 100. An increase in power of a power amplifier may result in excessive heat generation or power consumption due to low efficiency of the power amplifier included in the RFIC 200. Accordingly, an increase in antenna gain may be desirable to increase the transmission power. The antenna gain may be proportional to a size of an effective opening area of the antenna 100. However, in mobile phone applications in which space is limited, the effective opening area may also be limited, and as the antenna gain increases, a beam width output from the antenna 100 narrows, and thus, a communication range of the antenna 100 may be reduced.

According to some example embodiments, the antenna 100 may receive a differential signal from the RFIC 200 through at least two feed lines 15. Accordingly, as described below with reference to FIG. 4, high transmission power may be achieved without reducing the performance of the antenna 100 by supplying two signals, each having a phase directly opposite to the other, to feed points separated on the antenna 100. The RFIC 200 may be manufactured by using a semiconductor process, and thus, a restriction for integrating circuits for generating a differential signal may be relatively weak.

Figure 2A:
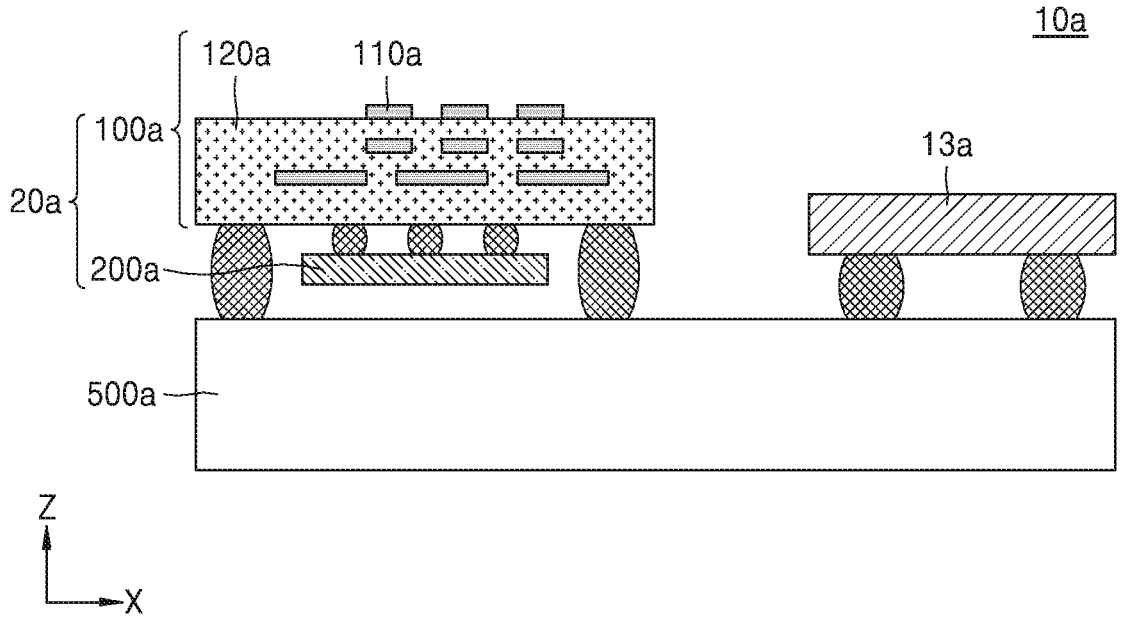
FIGS. 2A through 2C show layouts of constituent elements of the communication device of FIG. 1 according to some example embodiments.
Figure 2B:
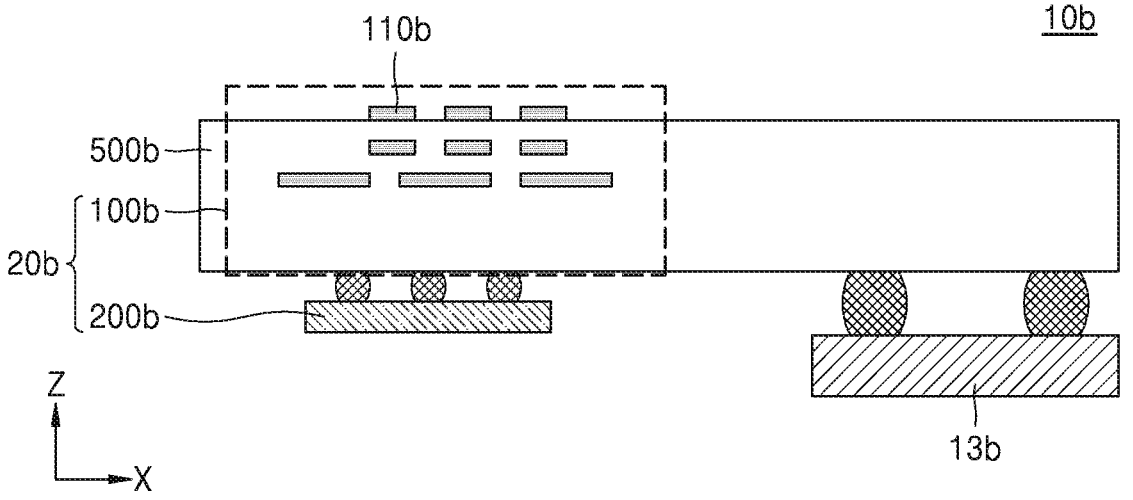
Figure 2C:
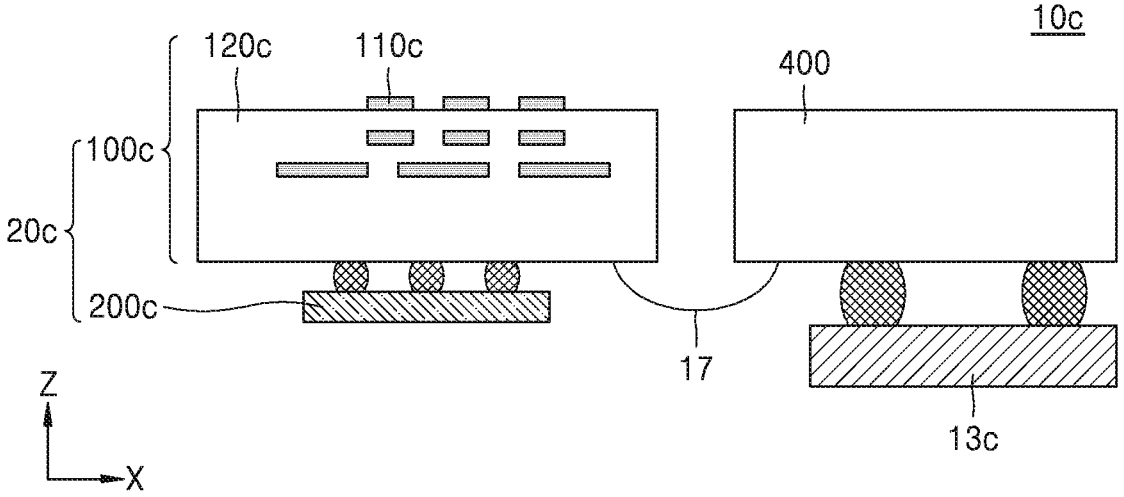

FIGS. 2A through 2C show layouts of constituent elements of the communication equipment 10 of FIG. 1 according to some example embodiments. Hereinafter, the layouts of constituent elements of the communication equipment 10 of FIGS. 2A through 2C will be described with reference to FIG. 1, and in the course of describing the layouts of constituent elements of the communication equipment 10 of FIGS. 2A through 2C, repeated descriptions may be omitted. In the present specification, an X-axis direction and a Y-axis direction perpendicular to each other may be referred to as a first horizontal direction and a second horizontal direction, respectively, and a plane formed by an X-axis and a Y-axis may be referred to as a horizontal plane. Also, an area may refer to an area on a plane parallel to the horizontal plane, and a direction perpendicular to the horizontal plane, that is, a Z-axis direction may be referred to as a vertical direction. Constituent elements disposed further in a +Z-axis direction relative to other constituent elements may be referred to as constituent elements disposed above the other constituent elements, and constituent elements disposed further in a −Z-axis direction relative to other constituent elements may be referred to as constituent elements disposed below the other constituent elements. Also, of surfaces of the constituent elements, the surfaces of the constituent elements furthest in the +Z-axis direction may be referred to as upper surfaces of the constituent elements, and the surfaces of the constituent elements furthest in the −Z-axis direction may be referred to as lower surfaces of the constituent elements.

In a high frequency band like the mmWave frequency band, loss parameters may worsen, and thus, it may be difficult to employ layouts of the antenna 100 and the RFIC 200 used in a low frequency band, for example, in a frequency band below 6 GHz. For example, an antenna feed line structure used in a low frequency band may reduce an attenuation characteristic of a signal in the mmWave frequency band and may degrade an Effective Isotropic Radiated Power (EIRP) and a noise figure. Accordingly, in order to reduce signal attenuation by the feed line 15 of FIG. 1, the antenna 100 and the RFIC 200 may be close to each other. In particular, in a mobile application like a mobile phone, a high space efficiency may be desired, and accordingly, as depicted in FIGS. 2A through 2C, a System-In-Package (SIP) structure in which the antenna 100 is disposed on the RFIC 200 may be employed.

Referring to FIG. 2A, communication equipment 10*a* may include an RF system 20*a*, a digital integrated circuit 13*a*, and a carrier board 500*a*. The RF system 20*a* and the digital integrated circuit 13*a* may be mounted on an upper surface of the carrier board 500*a*. The RF system 20*a* and the digital integrated circuit 13*a* may be connected to each other to be able to communicate with each other through conductive patterns formed in the carrier board 500*a*. In some example embodiments, the carrier board 500*a* may be a Printed Circuit Board (PCB). The digital integrated circuit 13*a* may include the signal processor 300 of FIG. 1, and accordingly, may transmit a transmitting signal TX to the RFIC 200*a* or may receive a receiving signal RX from the RFIC 200*a*, and also, may provide a control signal to the RFIC 200*a* to control the RFIC 200*a*. In some example embodiments, the digital integrated circuit 13*a* may include at least one core and/or a memory, and may control an operation of the communication equipment 10*a*. According to some example embodiments, operations described herein as being performed by the digital integrated circuit 13*a* may be performed by the at least one core executing commands and/or a software block stored in the memory.

The RF system 20*a* may include an antenna module 100*a* and the RFIC 200*a*. The antenna module 100*a* may be referred to as an antenna package, and as depicted in FIG. 2A, may include a substrate 120*a* and a conductor 110*a* formed on the substrate 120*a*. For example, as described below with reference to FIGS. 3A and 3B, the antenna module 100*a* may include a ground plate and a patch parallel to the horizontal plane, or may include a feed line for supplying a signal to the patch from the RFIC 200*a*. The RFIC 200*a* may have an upper surface electrically connected to a lower surface of the antenna module 100*a* and may be referred to as a radio die. In some example embodiments, the antenna module 100*a* and the RFIC 200*a* may be connected to each other through a controlled collapse chip connection (C4). The RF system 20*a* of FIG. 2A may be desirable for dissipating heat and may have a stable structure.

Referring to FIG. 2B, communication equipment 10*b* may include a digital integrated circuit 13*b* and a carrier board 500*b*. An RFIC 200*b* and the digital integrated circuit 13*b* may be mounted on a lower surface of the carrier board 500*b*. The RFIC 200*b* and the digital integrated circuit 13*b* may be connected to each other to be able to communicate with each other through conductive patterns formed in the carrier board 500*b*.

In the communication equipment 10*b* of FIG. 2B, an RF system 20*b* may include an antenna module 100*b* formed in the carrier board 500*b* and the RFIC 200*b* mounted on a lower surface of the carrier board 500*b*. As depicted in FIG. 2B, the antenna module 100*b* may include conductors 110*b* formed on the carrier board 500*b* and a feed line formed in the carrier board 500*b* to supply a signal from the RFIC 200*b* to the conductors 110*b*. In the communication equipment 10*b* of FIG. 2B, a process of mounting the RF system 20*b* on the carrier board 500*b* may be omitted and a substrate for an antenna may be omitted. Accordingly, the communication equipment 10*b* may have a reduced height, that is, a reduced length in the Z-axis direction.

Referring to FIG. 2C, communication equipment 10*c* may include an RF system 20*c*, a carrier board 400, and a digital integrated circuit 13*c*. As depicted in FIG. 2C, the digital integrated circuit 13*c* may be mounted on a lower surface of the carrier board 400, and the RF system 20*c* and the carrier board 400 may be connected to each other to be able to communicate with each other through a jumper 17.

In the communication equipment 10*c* of FIG. 2C, the RF system 20*c* may include an antenna module 100*c* and an RFIC 200*c* mounted on a lower surface of the antenna module 100*c*. As depicted in FIG. 2C, the antenna module 100*c* may include an antenna board 120*c*, conductors 110*c* formed on the antenna board 120*c*, and a feed line formed in the antenna board 120*c* to supply a signal from the RFIC 200*c* to the conductors 110*c*. In the communication equipment 10*c* of FIG. 2C, a substrate for an antenna may be omitted and the RF system 20*c* and the carrier board 400 may be independently manufactured, and thus, it the communication equipment 10*c* may be produced more efficiently and at reduced cost.

Hereinafter, some example embodiments may be described with reference to the RF system 20*a* of FIG. 2A. However, it should be understood that the descriptions may also be applicable to not only the RF systems 20*b* and 20*c* depicted in FIGS. 2B and 2C, respectively, but also to RF systems having other arbitrary structures (for example, a System-on-Chip (SoC) structure) that include an antenna module and an RFIC.

Figure 3A:
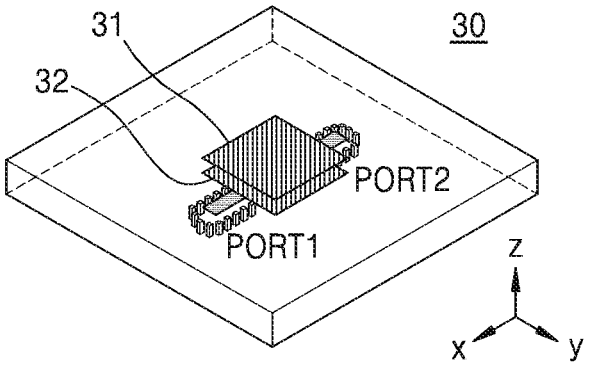
FIG. 3A is a perspective view of a 2-port antenna module according to some example embodiments.
Figure 3B:
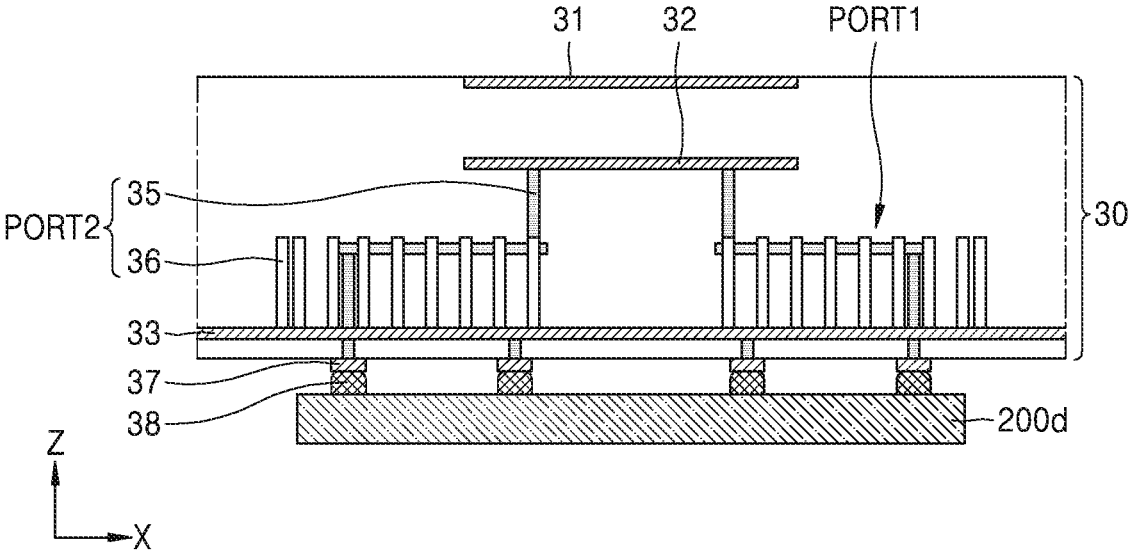
FIG. 3B is a side view of an RF system including the antenna module of FIG. 3A when the RF system is viewed from the y-axis direction, according to some example embodiments.

FIG. 3A is a perspective view of an antenna module 30 according to some example embodiments, and FIG. 3B is a side view of an RF system including the antenna module 30 of FIG. 3A when the RF system is viewed from the y-axis direction, according to some example embodiments. FIGS. 3A and 3B show a patch antenna as an example of the antenna module 30, and, for convenience of explanation, only some constituent elements of the antenna module 30 are depicted.

Referring to FIG. 3A, the antenna module 30 may include a top-patch 31 and a bottom-patch 32 that are separated parallel to each other in the Z-axis direction and may emit an electromagnetic wave in the +Z-axis direction. The top-patch 31 and the bottom-patch 32 may include a conductive material such as a metal, and as depicted in FIG. 3A, may have a rectangular shape. In some example embodiments, unlike the top-patch 31 and the bottom-patch 32 depicted in FIG. 3A, at least one of the top-patch 31 and the bottom-patch 32 may have a shape, such as a circular shape, an oval shape, a diamond shape, etc., different from the rectangular shape. Although not shown in FIG. 3A, as depicted in FIG. 3B, the antenna module 30 may further include a ground plate 33 below the bottom-patch 32, and in some example embodiments, the top-patch 31 may be omitted.

The antenna module 30 may include a first port PORT1 and a second port PORT2 that are connected to the bottom-patch 32. As depicted in FIG. 3A, the first port PORT1 and the second port PORT2 may be separated in the X-axis direction and may each include a feed line to supply a signal to the bottom-patch 32. As described below with reference to FIG. 4, the bottom-patch 32 may receive a differential signal from two feed points separated in the X-axis direction, and accordingly, may have high power efficiency.

Referring to FIG. 3B, an RFIC 200*d* may be mounted on a lower surface of the antenna module 30. The RFIC 200*d* may provide a signal, that is, a differential signal, to the bottom-patch 32 through the feed lines included in the first port PORT1 and the second port PORT2. For example, as depicted in FIG. 3B, the second port PORT2 may include a feed line 35 connected to the bottom-patch 32 and a plurality of buried vias 36. The feed line 35 may include portions (for example, vias) extending in the Z-axis direction and portions (for example, a metal pattern) extending in the X-axis direction. Feed points where the feed lines 35 of the first port PORT1 and the second port PORT2 are connected to the bottom-patch 32 may be separated from each other in the X-axis direction.

The buried vias 36 may be disposed to be separated from the feed lines 35. For example, as depicted in FIGS. 3A and 3B, the buried vias 36 may be regularly disposed by being separated in the X-axis direction and the Y-axis direction from the feed lines 35. The buried vias 36 may be configured to apply a potentiostat, and, for example, as depicted in FIG. 3B, the buried vias 36 may be connected to the ground plate 33.

The first port PORT1 may have the same structure as, or a similar structure to, the second port PORT2. In some example embodiments, the first port PORT1 and the second port PORT2 may have a symmetrical structure with a surface parallel to a plane formed by the Z-axis and the Y-axis as a center. The structures of the first port PORT1 and the second port PORT2 depicted in FIGS. 3A and 3B are only examples, and thus, it should be understood that ports having structures different from the structures depicted in FIGS. 3A and 3B may be separated in the X-axis direction to supply a differential signal to a patch.

An upper surface of the RFIC 200*d* may be electrically connected to a lower surface of the antenna module 30 through a plurality of paths. In some example embodiments, the antenna module 30 and the RFIC 200*d* may be connected to each other by using a flip chip method. For example, as depicted in FIG. 3B, metalized pads 37 may be disposed on a lower surface of the antenna module 30, and solder balls 38 may be respectively disposed on the metalized pads 37. The solder balls 38 may contact connectors configured of a conductor on an upper surface of the RFIC 200*d*. In this manner, the RFIC 200*d* may be connected to the feed line 35 through a controlled collapse chip connection (C4) and may supply one of the differential signals to the feed line 35 (and the other of the differential signal to the other feed line). Also, the RFIC 200*d* may be connected to the ground plate 33 and may apply a ground potential to the ground plate 33 or may receive a ground potential from the ground plate 33.

Figure 4:
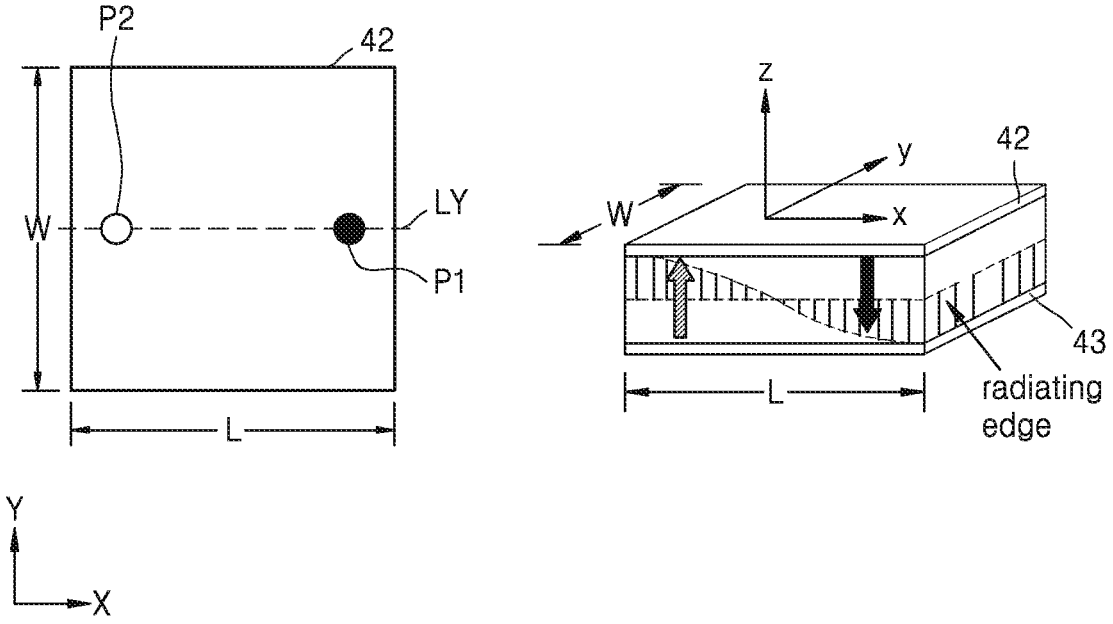
FIG. 4 is a diagram showing a patch according to some example embodiments and an electric field formed by the patch.

FIG. 4 is a schematic diagram of a patch 42 according to some example embodiments and an electric field formed by the patch 42. In detail, the drawing on the left side of FIG. 4 shows first and second feed points P1 and P2 respectively connected to two feed lines on a lower surface of the patch 42, and the drawing on the right side of FIG. 4 shows an electric field generated between the patch 42 and a ground plate 43.

Referring to the drawing on the left side of FIG. 4, the patch 42 may have a rectangular shape and may have a length L in the X-axis direction and a length W in the Y-axis direction. In some example embodiments, the length L in the X-axis direction may be a half of a wavelength emitted by a differential signal. The two feed lines may be connected to a lower surface of the patch 42 at the first and second feed points P1 and P2. The first and second feed points P1 and P2 may be separated in the X-axis direction, and locations of the first and second feed points P1 and P2 on the lower surface of the patch 42 may be determined by impedance matching. In some example embodiments, the first and second feed points P1 and P2 may be disposed on or near to a first center line LY that is parallel to the X-axis and crosses a center of the patch 42.

In an electric field distribution of a patch antenna, electric fields having phases opposite to each other may be formed on both ends of an axis where a signal is centrally fed. Accordingly, when two input signals having opposite phases, that is, differential signals, are applied to an axis where a signal is fed, transmission of higher power may be possible without reducing the performance of the patch antenna. For example, as depicted on the right side of FIG. 4, when a signal having a relatively higher potential is applied to the first feed point P1 and a signal having a relatively lower potential is applied to the second feed point P2 due to a differential signal, electric fields having opposite phases may be formed on both ends with an axis crossing the first and second feed points P1 and P2, that is, the axis parallel to the X-axis as a center. Accordingly, compared to a single feed line structure, an antenna gain may be maintained and an EIRP may be increased double. Hereinafter, favorable characteristics of antenna modules including two feed lines for supplying differential signals will be described with reference to FIGS. 5A and 5B.

Figure 5A:
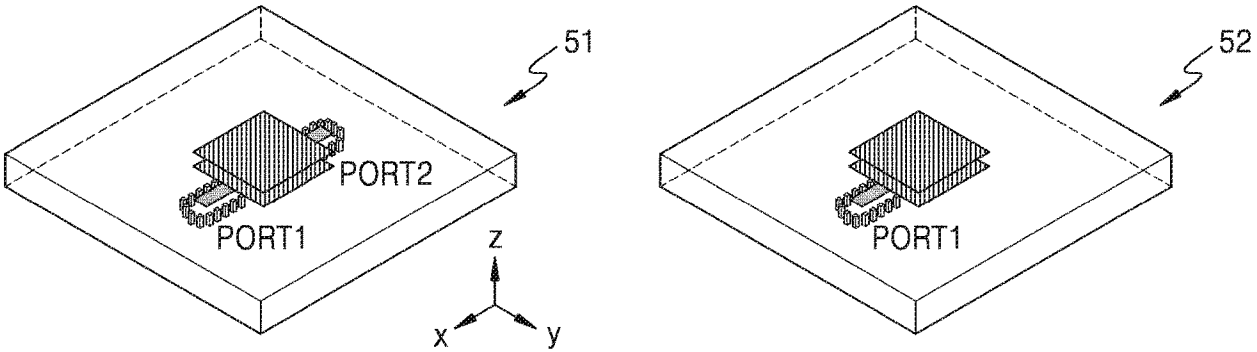
FIGS. 5A and 5B are diagrams summarizing simulation results of 2-port antenna modules.
Figure 5A:
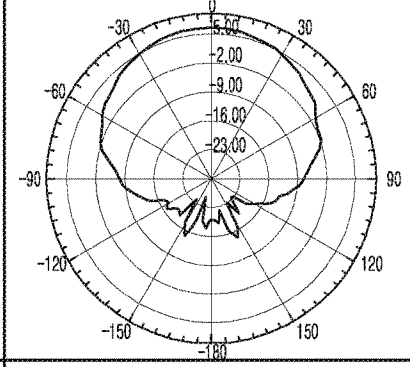
Figure 5A:
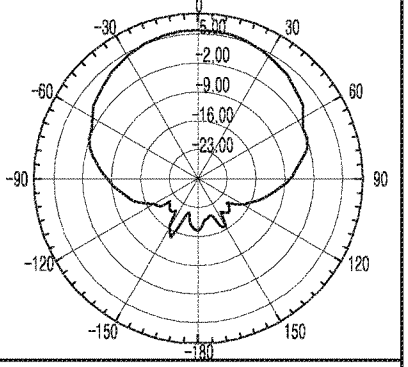
Figure 5B:
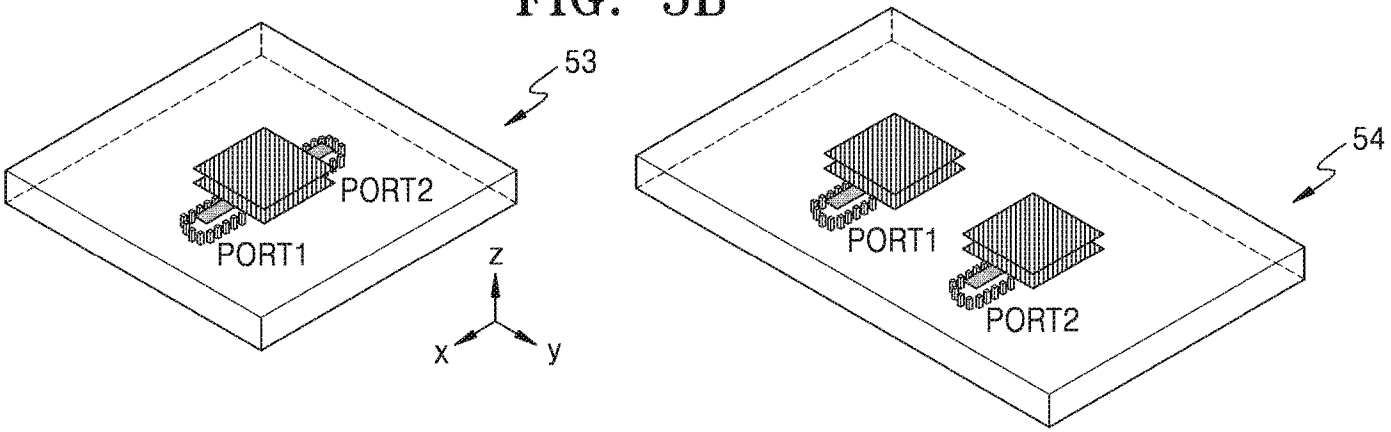
Figure 5B:
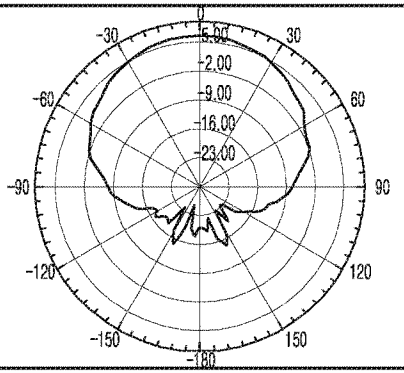
Figure 5B:
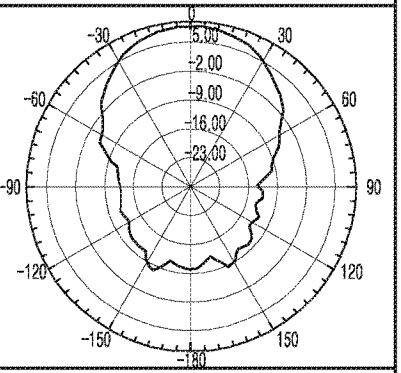

FIGS. 5A and 5B are diagrams summarizing simulation results of antenna modules. In detail, FIG. 5A shows simulation results of an antenna module 51 to which a differential signal is fed through two ports and an antenna module 52 to which a signal is fed through a single port. FIG. 5B shows simulation results of an antenna module 53 to which a differential signal is fed through two ports and an antenna module 54 including two patches to which signals are fed through respective single ports. Hereinafter, of the descriptions with respect to FIGS. 5A and 5B, repeated descriptions may be omitted.

Referring to FIG. 5A, the antenna module 51 including the first port PORT1 and the second port PORT2 may be referred to as a dual-fed patch antenna module 51, and the antenna module 52 including only the first port PORT1 may be referred to as a single-fed patch antenna module 52. Referring to the table of FIG. 5A, the dual-fed patch antenna module 51 may have a high antenna gain (that is, 6.52 dBi >5.92 dBi) as compared to the single-fed patch antenna module 52 at the same power output Pout of port (that is, at 10 dBm) and at different total power inputs Pout_total (that is at 13 dBm and 10 dBm respectively). Also, an EIRP and radiated power may be increased by greater than 3 dB without a power combining loss.

Referring to FIG. 5B, the antenna module 53 (may also be referred to as a dual-fed patch antenna module 53) may include the first port PORT1 and the second port PORT2 connected to a single lower patch. The antenna module 54 may include the first port PORT1 and the second port PORT2 respectively connected to two lower patches separated from each other in the Y-axis direction and may be referred to as a 1 by2 patch array antenna. Referring to the table of FIG. 5B, comparing the dual-fed patch antenna module 53 to the 1 by2 antenna module 54, the dual-fed patch antenna module 53 may have a reduced antenna gain. However, the dual-fed patch antenna module 53 occupies a smaller area (that is, 8 mm×8 mm<13 mm×8 mm), and also may provide a wider beamwidth according to a radiation pattern, as compared to the 1 by2 antenna module 54.

Figure 6A:
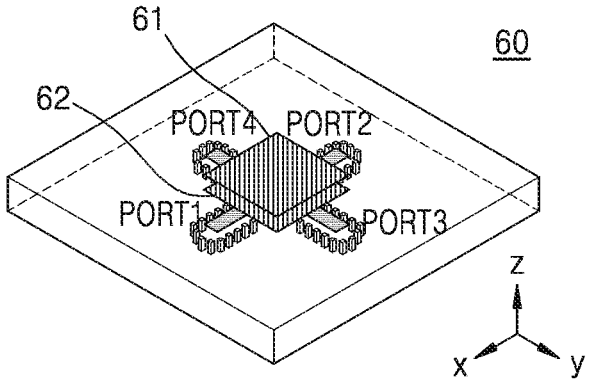
FIG. 6A is a perspective view of a 4-port antenna module according to some example embodiments.
Figure 6B:
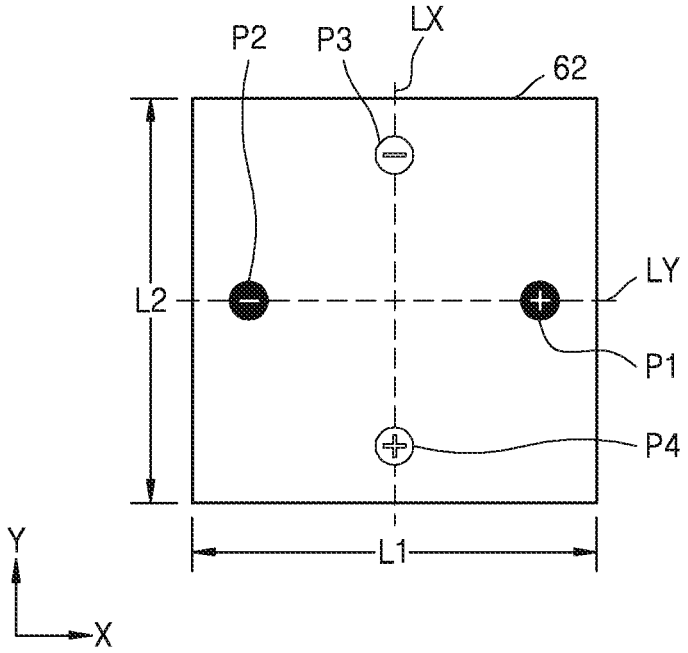
FIG. 6B shows a lower surface of a lower patch of FIG. 6A.

FIG. 6A is a perspective view of an antenna module 60 according to some example embodiments, and FIG. 6B shows a lower surface of a bottom-patch 62 of the antenna module 60 depicted in FIG. 6A. FIGS. 6A and 6B show a patch antenna as an example of the antenna module 60, and, for convenience of explanation, only some constituent elements of the antenna module 60 are depicted.

Referring to FIG. 6A, the antenna module 60 may include a top-patch 61 and the bottom-patch 62 that are parallel to each other and separated in the Z-axis direction, and may emit an electromagnetic wave in the +Z-axis direction. Similar to the antenna module 30 of FIG. 3A, the top-patch 61 and the bottom-patch 62 may include a conductive material such as a metal, and as depicted in FIG. 6A, may have a rectangular shape. Although not shown in FIG. 6A, as depicted in FIG. 3B, the antenna module 60 may further include a ground plate below the bottom-patch 62, and in some example embodiments, the top-patch 61 may be omitted.

The antenna module 60 may include four ports, that is, first through fourth ports PORT1 through PORT4. As depicted in FIG. 6A, the first port PORT1 and the second port PORT2 may be separated from each other in the X-axis direction, and the third port PORT3 and the fourth port PORT4 may be separated from each other in the Y-axis direction. In some example embodiments, the first through fourth ports PORT1 through PORT4, respectively, may have the same or similar structures as the port structures described with respect to FIG. 3A.

The bottom-patch 62 may receive a first differential signal through the first port PORT1 and the second port PORT2 that are separated from each other in the X-axis direction and may receive a second differential signal through the third port PORT3 and the fourth port PORT4 that are separated from each other in the Y-axis direction. An RFIC (for example, 200*a* of FIG. 2A) connected to the antenna module 60 may generate the first and second differential signals and may provide the first and second differential signals to the antenna module 60. Accordingly, as described with reference to FIG. 4, the antenna module 60 may have high power efficiency due to the first port PORT1 and the second port PORT2 that provide the first differential signal and the third port PORT3 and the fourth port PORT4 that provide the second differential signal. Also, due to the first port PORT1 and the second port PORT2 that are separated from each other in the X-axis direction and the third port PORT3 and the fourth port PORT4 that are separated from each other in the Y-axis direction, the antenna module 60 may provide dual-polarization.

Referring to FIG. 6B, the bottom patch 62 may have a rectangular shape, a length L1 in the X-axis direction, and a length L2 in the Y-axis direction. Four feed lines respectively included in the four ports, that is, the first through fourth ports PORT1 through PORT4, may be connected to a lower surface of the bottom-patch 62 at four feed points, that is, first through fourth feed points P1 through P4. That is, the feed line of the first port PORT1 may be connected to the bottom-patch 62 at the first feed point P1, the feed line of the second port PORT2 may be connected to the bottom-patch 62 at the second feed point P2, the feed line of the third port PORT3 may be connected to the bottom-patch 62 at the third feed point P3, and the feed line of the fourth port PORT4 may be connected to the bottom-patch 62 at the fourth feed point P4. Accordingly, as indicated by filled circles in FIG. 6B, a first differential signal may be applied to the first and second feed points P1 and P2. Also, as indicated by circles inside of which are empty in FIG. 6B, a second differential signal may be applied to the third and fourth feed points P3 and P4.

In some example embodiments, the length L1 of the bottom-patch 62 in the X-axis direction may be a half of an emission wavelength generated by the first differential signal, and the length L2 of the bottom-patch 62 in the Y-axis direction may be a half of an emission wavelength generated by the second differential signal. Locations of the first through fourth feed points P1 through P4 may be determined by impedance matching. In some example embodiments, the first and second feed points P1 and P2 may be disposed on or near to a first center line LY that is parallel to the X-axis and crosses a center of the bottom-patch 62. In some example embodiments, the third and fourth feed points P3 and P4 may be disposed on or near to a second center line LX that is parallel to the Y-axis and crosses the center of the bottom-patch 62.

Figure 7:
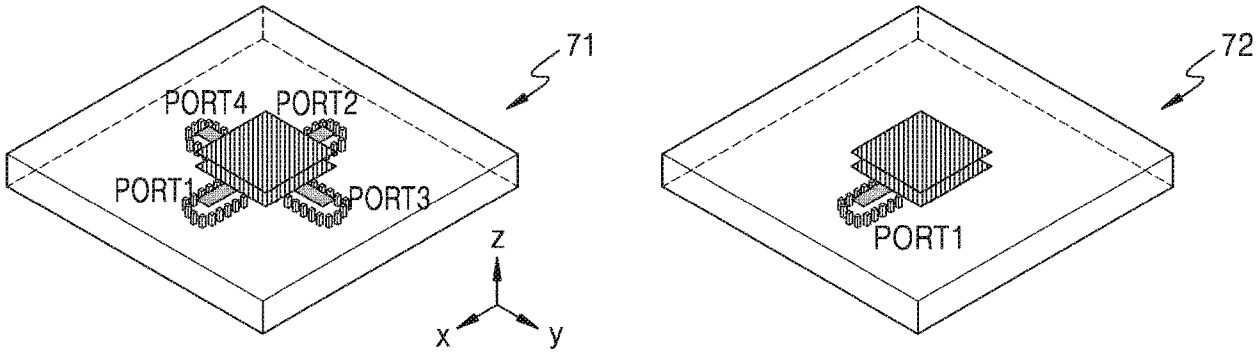
FIG. 7 is a diagram summarizing simulation results of 4-port antenna modules.
Figure 7:
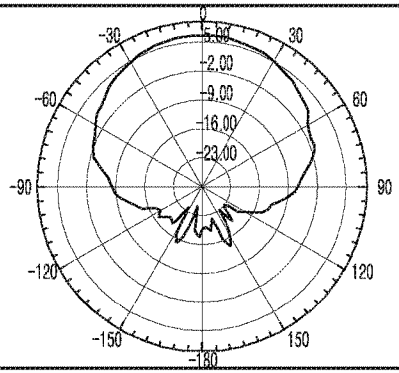
Figure 7:
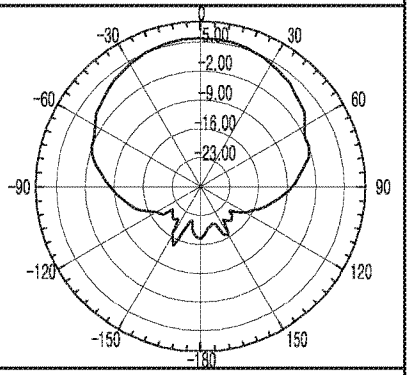

FIG. 7 is a diagram summarizing simulation results of antenna modules. In detail, FIG. 7 shows simulation results of an antenna module 71 to which two differential signals are fed through four ports and an antenna module 72 to which a signal is fed through a single port.

Referring to FIG. 7, the antenna module 71 including a first port PORT1, a second port PORT2, a third port PORT3, and a fourth port PORT4 may be referred to as a dual-fed/dual-polarized patch antenna module 71, and the antenna module 72 that includes only the first port PORT1 may be referred to as a single-fed patch antenna module 72. Referring to the table of FIG. 7, comparing the dual-fed/dual-polarized patch antenna module 71 to the single-fed patch antenna module 72 at the same power output Pout of port (that is, 10 dBm) and at different total power inputs Pout_total (that is, at 13 dBm and 10 dBm, respectively), the dual-fed/dual-polarized patch antenna module 71 may have the same area (that is, 8 mm×8 mm) as the single-fed patch antenna module 72, and also, an EIRP and radiated power may be increased by greater than 3 dB without a power combining loss. As a result, the simulation results indicate that a dual-fed structure may be applied to a dual-polarized application without a power combining loss.

Figure 8:
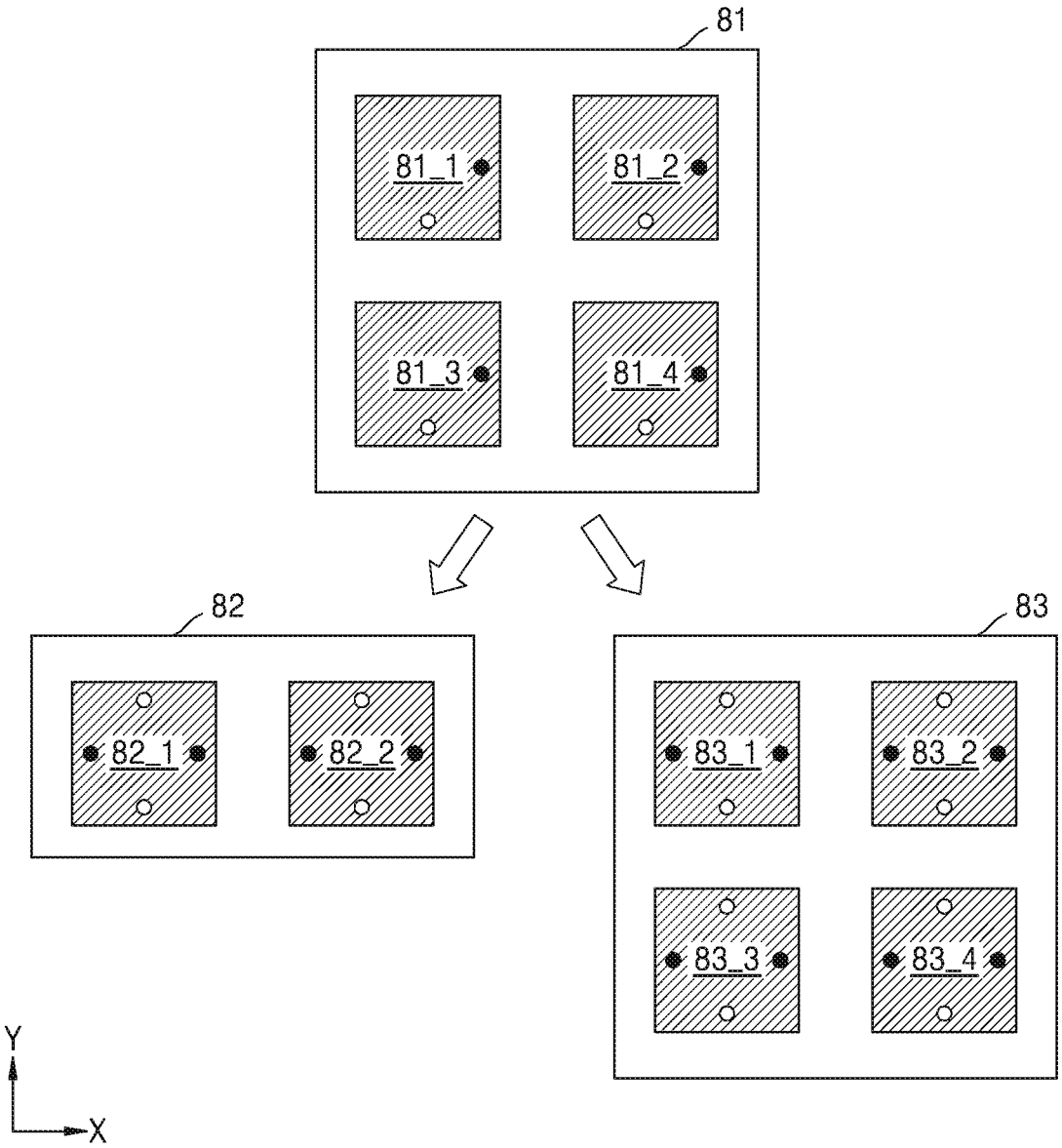
FIG. 8 is a diagram of antenna modules according to some example embodiments.

FIG. 8 is a diagram of antenna modules according to some example embodiments. In detail, FIG. 8 shows antenna modules 82 and 83 having more favorable characteristics than an antenna module 81 corresponding to a dual-polarized antenna.

Referring to FIG. 8, the antenna module 81 may include first through fourth patches 81_1 through 81_4, and each of the first through fourth patches 81_1 through 81_4 may have a single-fed/dual-polarized structure. For example, in each of the first through fourth patches 81_1 through 81_4, an electric field having a size that varies in a direction parallel to the X-axis is formed by a signal applied to a feed point indicated by a filled circle, and also, an electric field having a size that varies in a direction parallel to the Y-axis is formed by a signal applied to a feed point indicated by a blank circle.

As described with reference to FIGS. 4, 5A, and 5B, an antenna module having a dual-fed structure may have an increased EIRP, and the antenna modules 82 and 83 having a dual-fed structure may be employed according to constraints of an application. For example, in the case of a communication device with spatial constraints, the antenna module 82 having a dual-fed/dual-polarized 1×2 patch array structure including two patches 81_1 and 82_2 may be used. Comparing the antenna module 82 to the antenna module 81 at the same power input, the antenna module 82 may have a reduced area while providing a similar EIRP. Also, in the case of a communication device using high emission power with limited power resources, the antenna module 83 having a dual-fed/dual-polarized 2by2 patch array structure including four patches 83_1 through 83_4 may be used. When the antenna module 83 is compared with the antenna module 81 at the same power input, the antenna module 83 may provide a higher EIRP while having the same area. The antenna modules 82 and 83 are examples, and thus, it should be understood that antenna modules having a dual-fed structure including patches disposed in various ways according to an application may be employed.

Figure 9A:
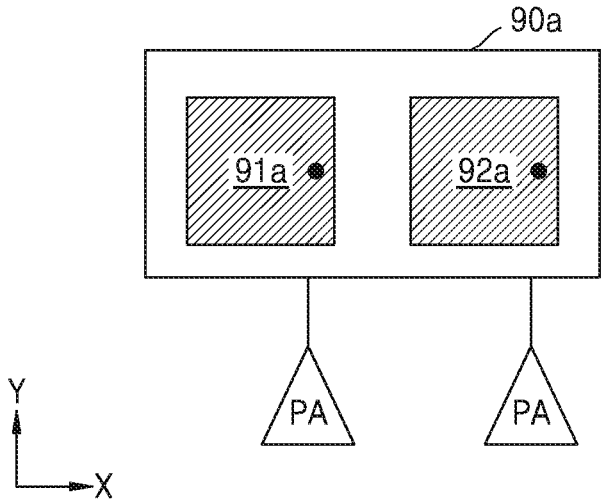
FIGS. 9A through 9C are antennas according to some example embodiments.
Figure 9B:
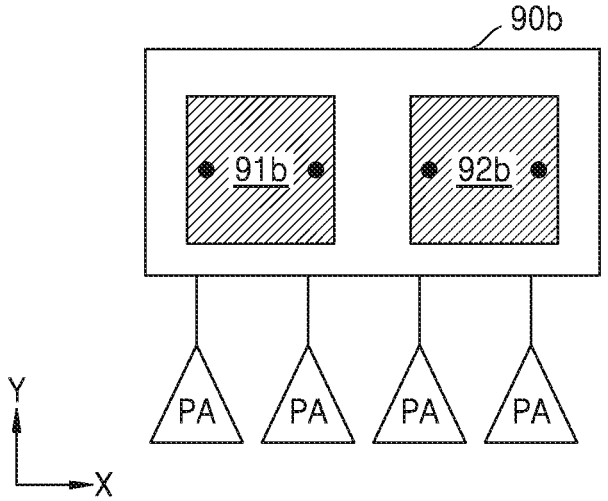
Figure 9C:
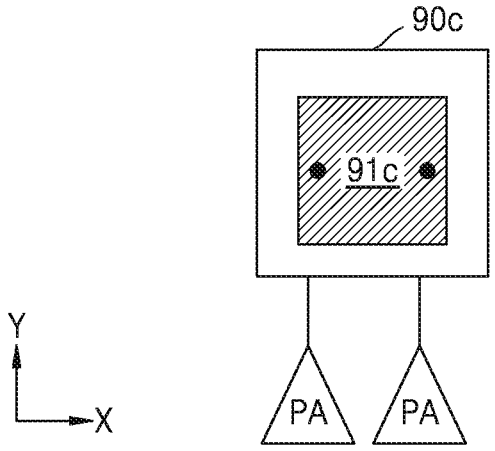

FIGS. 9A through 9C are antennas according to some example embodiments. In detail, FIG. 9A shows an antenna module 90*a* having a single-fed 1×2 patch array structure according to a comparative example, FIG. 9B shows an antenna module 90*b* having a dual-fed 1×2 patch array structure according to some example embodiments, and FIG. 9C shows an antenna module 90*c* having a dual-fed single patch structure.

Referring to FIG. 9A, a first patch 91*a* and a second patch 92*a* included in the antenna module 90*a* may each receive a signal from a single power amplifier through a single feed point. Referring to FIG. 9B, a first patch 91*b* and a second patch 92*b* included in the antenna module 90*b* may each receive a differential signal from two power amplifiers through two feed points. Referring to FIG. 9C, a first patch 91*c* included in the antenna module 90*c* may receive a differential signal from two power amplifiers through two feed points. In FIGS. 9A through 9C, it is assumed that the lengths of the feed lines connected to the patches are equal, the power amplifiers each output power of 6 dBm, and each of the patches of the antenna modules 90*a*, 90*b*, and 90*c* provides an antenna gain of 5 dBi.

An EIRP by the antenna module 90*a* may be calculated by Equation 1 as below.

$$17\ \text{dBm}=6\ \text{dBm}+10\log_{10}2+5\ \text{dBi}+10\log_{10}2 \qquad \text{[Equation 1]}$$

In Equation 1, the front $10\log_{10}2$ may correspond to the two power amplifiers, and the rear $10\log_{10}2$ may correspond to the first and second patches 91*a* and 92*a*.

An EIRP by the antenna module 90*b* may be calculated by Equation 2 as below.

$$20\ \text{dBm}=6\ \text{dBm}+10\log_{10}4+5\ \text{dBi}+10\log_{10}2 \qquad \text{[Equation 2]}$$

In Equation 2, $10\log_{10}4$ may correspond to the four power amplifiers, and $10\log_{10}2$ may correspond to the first and second patches 91*b* and 92*b*. Accordingly, a high EIRP may be achieved by a dual-fed structure in the same 1×2 patch array. On the other hand, in the case when output power of the power amplifiers of FIG. 9B is lowered to 3 dBm to reduce power consumption of the power amplifiers, an EIRP by the antenna module 90*b* of FIG. 9B may be calculated as Equation 3, and accordingly, the same EIRP of the antenna module 90*a* of FIG. 9A may be achieved.

$$17\ \text{dBm}=3\ \text{dBm}+10\log_{10}4+5\ \text{dBi}+10\log_{10}2 \qquad \text{[Equation 3]}$$

The EIRP of the antenna module 90*c* of FIG. 9C may be calculated as Equation 4 below. When compared to the antenna module 90*a* of FIG. 9A, the EIRP is reduced. However, an area reduced by approximately 40% may be achieved by using a single patch.

$$14\ \text{dBm}=6\ \text{dBm}+10\log_{10}2+5\ \text{dBi} \qquad \text{[Equation 4]}$$

Figure 10:
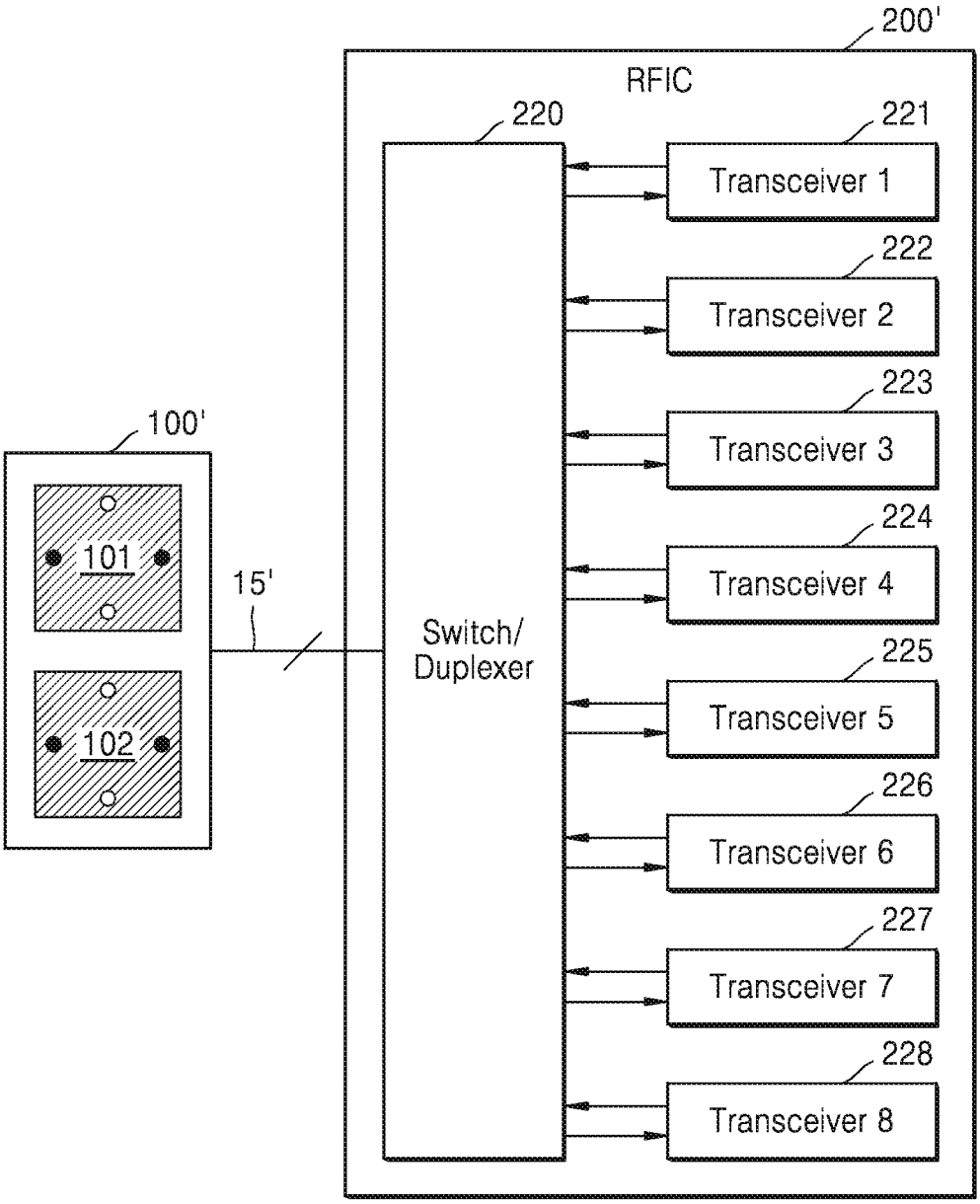
FIG. 10 is a block diagram of an antenna and an RFIC according to some example embodiments.

FIG. 10 is a block diagram of an antenna 100' and an RFIC 200' according to some example embodiments. In detail, FIG. 10 shows the antenna 100' including first and second patches 101 and 102 having a dual-fed/dual-polarized structure and the RFIC 200' including first through eighth transceivers 221 through 228.

The RFIC 200' may be connected to the antenna 100' through eight feed lines 15' corresponding to eight ports of the antenna 100'. For example, as described above with reference to FIGS. 2A through 2C, the antenna 100' and an antenna module including the feed lines 15' may be disposed on the RFIC 200', and at least one connection may be formed on an upper surface of the RFIC 200' and on a lower surface of the antenna module. The antenna 100' may receive four differential signals from the RFIC 200' through the eight feed lines 15' that are respectively connected to eight feed points on the first and second patches 101 and 102. For this operation, each pair of transceivers included in the RFIC 200' may generate a single differential signal, and accordingly, the first through eighth transceivers 221 through 228 may generate four differential signals.

A switch/duplexer 220 may connect or disconnect output terminals or input terminals of the first through eighth transceivers 221 through 228 to the eight feed lines 15' according to a transmitting mode or a receiving mode. For example, in a transmitting mode, the switch/duplexer 220 may connect the output terminal of the first transceiver 221 to the first feed line of the eight feed lines 15', and may disconnect the connection between the input terminal of the first transceiver 221 and the first feed line. Also, in a receiving mode, the switch/duplexer 220 may connect the input terminal of the first transceiver 221 to the first feed line, and may disconnect the connection between the output terminal of the first transceiver 221 to the first feed line. An example of the transceivers included in the RFIC 200' will be described below with reference to FIG. 11.

Figure 11:
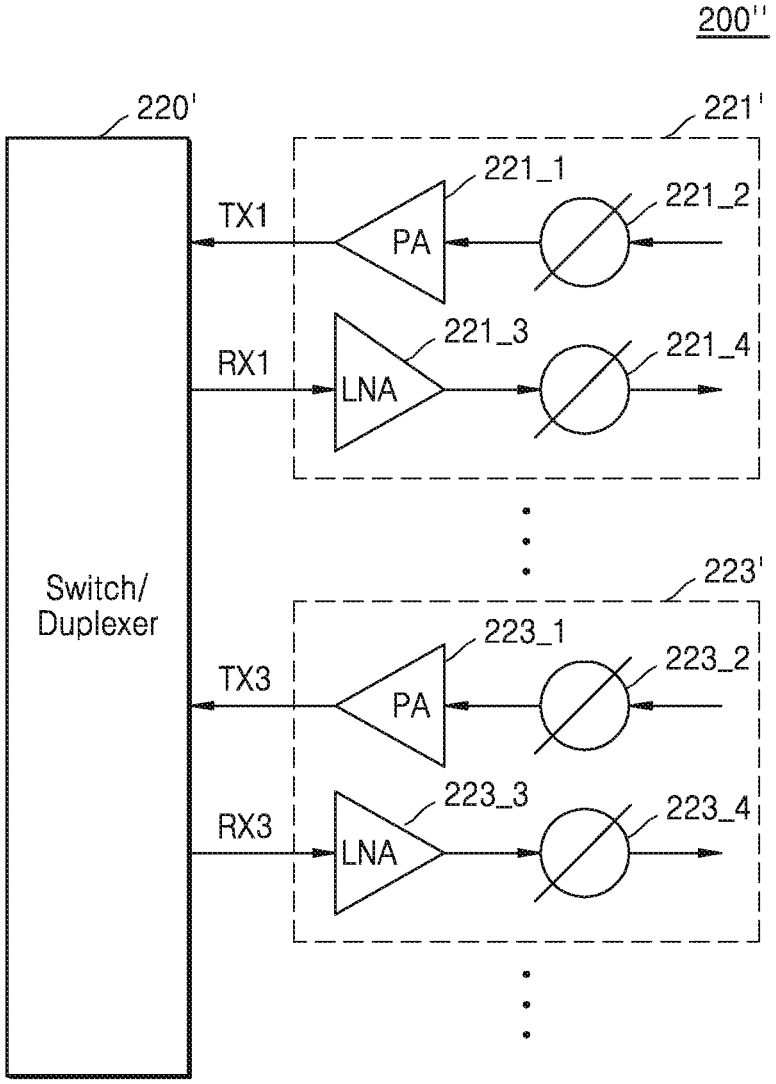
FIG. 11 is a block diagram of an RFIC according to some example embodiments.

FIG. 11 is a block diagram of an RFIC 200" according to some example embodiments. In detail, FIG. 11 shows an example of the transceivers included in the RFIC 200' of FIG. 10. As described above with reference to FIG. 10, a first transceiver 221' and a third transceiver 223' may output a differential signal, and a switch/duplexer 220' may transmit the differential signal to feed lines in a transmitting mode. That is, a first transmitting signal TX1 emitted from the first transceiver 221' and a third transmitting signal TX3 emitted from the third transceiver 223' may be applied to two separate feed points on a single patch. Also, a first receiving signal RX1 received by the first transceiver 221' and a third receiving signal RX3 received by the third transceiver 223' may be received by two separate feed points on a single patch.

Referring to FIG. 11, the first transceiver 221' may include a power amplifier 221_1, a low noise amplifier 221_3, and phase shifters 221_2 and 221_4. Similar to the first transceiver 221', the third transceiver 223' may include a power amplifier 223_1, a low noise amplifier 223_3, and phase shifters 223_2 and 223_4. In a transmitting mode, the power amplifiers 221_1 and 223_1 of the first transceiver 221' and the third transceiver 223' may respectively output the first transmitting signal TX1 and the third transmitting signal TX3. In a receiving mode, the low noise amplifiers 221_3 and 223_3 of the first transceiver 221' and the third transceiver 223' may respectively receive the first receiving signal RX1 and the third receiving signal RX3.

The phase shifters 221_2 and 221_4 of the first transceiver 221' and the phase shifters 223_2 and 223_4 of the third transceiver 223' may provide a phase difference of 180 degrees. For example, the transmission phase shifter 221_2 of the first transceiver 221' may provide an output signal having a phase difference of zero degree with respect to an input signal directed to the power amplifier 221_1, and the transmission phase shifter 223_2 of the third transceiver 223' may provide an output signal having a phase difference of 180 degrees with respect to the same input signal, provided to the transmission phase shifter 221_2 of the first transceiver 221', directed to the power amplifier 223_1. Accordingly, the first transmitting signal TX1 and the third transmitting signal TX3 may have a phase difference of 180 degrees, and may correspond to a differential signal. Also, the reception phase shifter 221_4 of the first transceiver 221' may output a signal having a phase difference of zero degree with respect to an output signal of the low noise amplifier 221_3, and the reception phase shifter 223_4 of the third transceiver 223' may output a signal having a phase difference of 180 degrees with respect to an output signal of the low noise amplifier 223_3.

Figure 12:
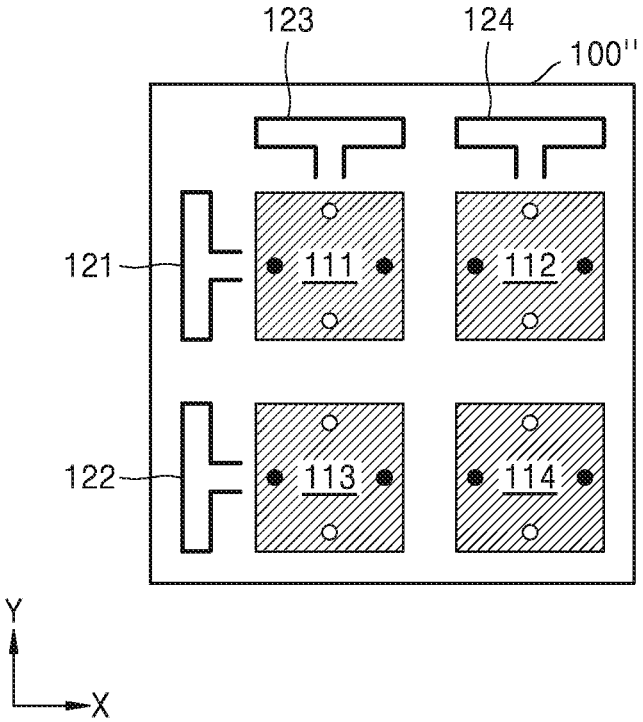
FIG. 12 is a diagram of an antenna module including dipole and patch antennas according to some example embodiments.

FIG. 12 is a diagram of an antenna module 100" according to some example embodiments. As described above with reference to the drawings, the antenna module 100" may include patch antennas 111 through 114 respectively connected to a plurality of feed lines supplying differential signals. Also, to achieve dual-polarized patch antennas, two differential signals may be applied to each of the patch antennas 111 through 114.

Referring to FIG. 12, the antenna module 100" may include dipole antennas 121 through 124 in addition to the patch antennas 111 through 114. In this way, the coverage of the antenna module 100" may be expanded by adding different kind of antennas to the patch antennas 111 through 114. The patch antennas 111 through 114 and the dipole antennas 121 through 124 of FIG. 12 are only examples, and thus, it should be understood that antennas may be disposed in different ways from the disposition of the antennas of FIG. 12.

Figure 13:
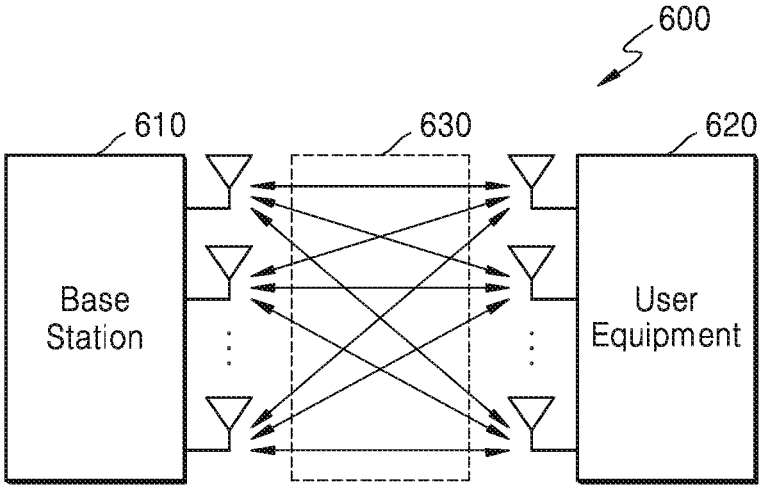
FIG. 13 is a block diagram of a wireless communication system according to some example embodiments.

FIG. 13 is a block diagram of communication devices including an antenna according to some example embodiments. In detail, FIG. 13 shows an example of wireless communication between a base station 610 and user equipment 620 in a wireless communication system 600. One or both of base station 610 and the user equipment 620 may include a multi-fed structure antenna, and may include an RFIC that provides a differential signal.

The base station 610 may be a fixed station that communicates with the user equipment 620 and/or another base station. For example, the base station 610 may be referred to as a Node B, an eNB (evolved-Node B), a sector, a site, a Base Transceiver System (BTS), an access pint, a relay node, a Remote Radio Head (RRH), a Radio Unit (RU), a small cell, etc. The user equipment 620 may be fixed or movable, and may transmit and receive data and/or control information by communicating with the base station 610. For example, the user equipment 620 may be referred to as terminal equipment, a mobile station (MS), a mobile terminal (MT), a user terminal (UT), a subscriber station (SS), a wireless device, a handheld device, etc.

As depicted in FIG. 13, the base station 610 and the user equipment 620 may each include a plurality of antennas, and may perform wireless communication through a multiple-input multiple-output channel 630. Each of the antennas may have a multi-fed structure and/or a dual-polarized structure according to some example embodiments. A differential signal may be provided to the antennas by an RFIC, and the respective antennas of the base station 610 and/or the user equipment 620 may be configured according to constraints of a particular application. For example, an EIRP may be increased by increasing RF paths double, and accordingly, an area (or form factor) of the antenna may be reduced to a half. Also, the improved EIRP enables the achievement of wide beams, the reduction in DC power dissipation to a half, and the reduction in complexity of phase resolution. Also, since an increased number of RF paths of the RFIC may be used, a mmWave antenna module may be readily realized using reduced transmission power. Also, according to some example embodiments, a dual-polarized patch antenna may be readily realized by applying two pairs of differential fed-structures to a single patch antenna.

Figure 14:
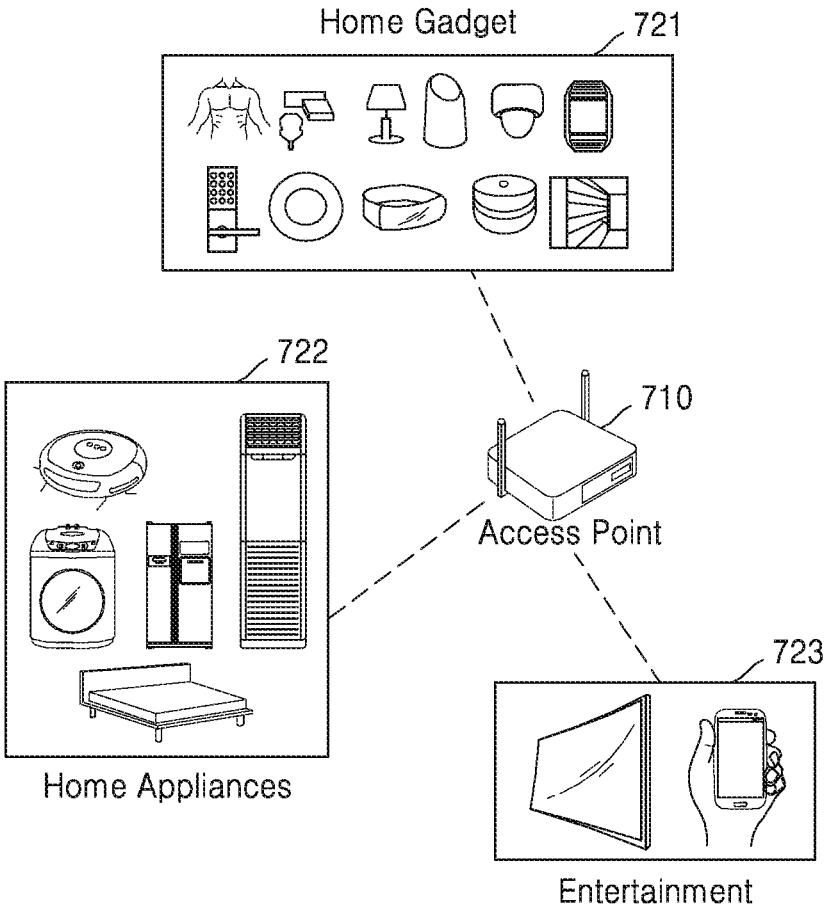
FIG. 14 is a diagram showing a wireless communication system including a Wireless Local Area Network (WLAN) according to some example embodiments.

FIG. 14 is a diagram showing communication devices including an antenna according to some example embodiments. In detail, FIG. 14 shows an example of mutual communication of various wireless communication devices in a wireless communication system that uses a WLAN. The various wireless communication devices depicted in FIG. 14 respectively may include a multi-fed antenna and may include an RFIC that provides a differential signal to the multi-fed antenna.

Home gadgets 721, home appliances 722, entertainment devices 723, and an Access Point (AP) 710 may constitute an Internet of Things (IoT). The home gadgets 721, the home appliances 722, the entertainment devices 723, and the AP 710 each may include a transceiver according to some example embodiments as a part thereof. The home gadgets 721, the home appliances 722, and the entertainment devices 723 may wireless communicate with each other via the AP 710.

As described above, some example embodiments have been disclosed in the drawings and specification. In the present specification, some example embodiments are described by using some specific terms, but the terms used are for the purpose of describing the technical scope of the inventive concepts only and are not intended to be limiting of meanings or the technical scope described in the claims. Therefore, it will be understood by those skilled in the art that various changes in form and details may be made therein without departing from the spirit and scope of the inventive concepts as defined by the appended claims. Accordingly, the scope of the inventive concepts is defined not by the detailed description of the inventive concepts but by the appended claims.

What is claimed is:

1. A radio frequency (RF) device, comprising:

a radio frequency integrated circuit (RFIC) chip; and an antenna module on an upper surface of the RFIC chip, the antenna module comprises:

a first patch parallel to the RFIC chip and having an upper surface configured to emit radiation in a vertical direction opposite the first patch from the RFIC chip, a ground plate parallel to the first patch, and between the first patch and the RFIC chip, and a first plurality of feed lines connected to a lower surface of the first patch and configured to supply a plurality of first sets of differential signals to the first patch from the RFIC chip, each of the plurality of first sets of differential signals including two signals of opposite phase, wherein the first plurality of feed lines comprise:

a first feed line and a second feed line respectively connected to a first feed point and a second feed point on the lower surface of the first patch and configured to supply one of the plurality of first sets of differential signals to the first patch, and a third feed line and a fourth feed line respectively connected to a third feed point and a fourth feed point on the lower surface of the first patch and configured to supply another one of the plurality of first sets of differential signals to the first patch, the first feed point, the second feed point, the third feed point and the fourth feed point are disposed on the lower surface of the first patch for a dual polarization.

2. The RF device of claim 1, wherein the first feed point and the second feed point are separated in a first horizontal direction.

3. The RF device of claim 2, wherein the first feed point and the second feed point are proximate to a first center line crossing a center of the first patch in the first horizontal direction.

4. The RF device of claim 2, wherein the first feed point and the second feed point are equally proximate to a center of the first patch.

5. The RF device of claim 2, wherein the first feed line comprises a first portion extending in the first horizontal direction and a second portion extending in the vertical direction, and the second feed line comprises a first portion extending in the first horizontal direction and a second portion extending in the vertical direction.

6. The RF device of claim 2, wherein each of the upper surface of the first patch and the lower surface of the first patch have a rectangular shape including a pair of sides parallel to the first horizontal direction.

7. The RF device of claim 2, wherein the third feed point and the fourth feed point are separated in a second horizontal direction perpendicular to the first horizontal direction.

8. The RF device of claim 7, wherein the third feed point and the fourth feed point are proximate to a second center line crossing a center of the first patch in the second horizontal direction.

9. The RF device of claim 7, wherein the third feed point and the fourth feed point are equally proximate to a center of the first patch.

10. The RF device of claim 7, wherein the third feed line comprises a first portion extending in the second horizontal direction and a second portion extending in the vertical direction, and the fourth feed line comprises a first portion extending in the second horizontal direction and a second portion extending in the vertical direction.

11. The RF device of claim 7, wherein the antenna module further comprises:

a second patch separated from the first patch in the first horizontal direction; and a second plurality of feed lines connected to a lower surface of the second patch and configured to supply at least one second differential signal to the second patch from the RFIC chip.

12. The RF device of claim 11, wherein the antenna module further comprises:

a third patch separated from the first patch in the second horizontal direction;

a fourth patch separated from the second patch in the second horizontal direction; and a third plurality of feed lines respectively connected to lower surfaces of the third patch and the fourth patch and configured to supply at least one third differential signal to the third patch and the fourth patch from the RFIC chip.

13. The RF device of claim 1, wherein the antenna module further comprises a top-patch parallel to the first patch over the upper surface of the first patch.

14. The RF device of claim 1, wherein the RFIC chip comprises:

at least one phase shifter configured to generate the plurality of first sets of differential signals.

15. The RF device of claim 1, wherein the upper surface of the first patch is further configured to receive radiation and provide corresponding signals to the RFIC chip via the first plurality of feed lines, and the RFIC chip comprises at least one phase shifter configured to process the signals received through the first plurality of feed lines.

16. An antenna module comprising:

a ground plate;

a first patch parallel to the ground plate and having an upper surface configured to emit radiation in a vertical direction opposite the first patch from the ground plate; and a first plurality of feed lines respectively connected to a first plurality of feed points on a lower surface of the first patch and configured to supply a plurality of first sets of differential signals to the first patch, each of the plurality of first sets of differential signals including two signals of opposite phase, wherein the first plurality of feed points comprise:

a first feed point and a second feed point separated from each other in a first horizontal direction for a first polarization, and a third feed point and a fourth feed point separated from each other in a second horizontal direction perpendicular to the first horizontal direction for a second polarization.

17. The antenna module of claim 16, wherein the first feed point and the second feed point are proximate to a first center line crossing a center of the first patch in the first horizontal direction, and the third feed point and the fourth feed point are proximate to a second center line crossing the center of the first patch in the second horizontal direction.

18. The antenna module of claim 16, wherein the first feed point and a second feed point are equally proximate to a center of the first patch, and the third feed point and the fourth feed point are equally proximate to the center of the first patch.

19. The antenna module of claim 16, further comprising:

a second patch separated from the first patch in the first horizontal direction; and a second plurality of feed lines respectively connected to a second plurality of feed points on a lower surface of the second patch.

20. The antenna module of claim 19, further comprising:

a third patch separated from the first patch in the second horizontal direction;

a fourth patch separated from the second patch in the second horizontal direction; and a third plurality of feed lines respectively connected to a third plurality of feed points on lower surfaces of the third patch and the fourth patch.

* * * * *